United States Patent [19]

Cupp

[11] Patent Number: 4,826,122

[45] Date of Patent: May 2, 1989

[54] ADJUSTABLE BASE BRACKET FOR PITCHED ROOF SCAFFOLDING POST

[76] Inventor: John P. Cupp, 116 Feasterville Rd., Feasterville, Pa. 19047

[21] Appl. No.: 48,407

[22] Filed: May 11, 1987

[51] Int. Cl.[4] ..... E04G 5/02

[52] U.S. Cl. ..... 248/237; 182/111; 182/82

[58] Field of Search ..... 248/514, 519, 520, 538, 248/539, 133, 371, 185, 237, 219.2, 291, 238; 182/111, 93, 82, 108

[56] References Cited

U.S. PATENT DOCUMENTS

| | | | |
|---|---|---|---|
| 1,226,169 | 5/1917 | Bauer | 248/237 |
| 1,452,717 | 4/1923 | Wertz | 182/45 |
| 1,457,066 | 5/1923 | Kestner | 248/235 |
| 1,570,576 | 1/1926 | Rivitz | 182/111 |
| 2,469,981 | 5/1949 | Nelson | 248/235 |
| 2,653,002 | 9/1953 | Passman | 248/291 |
| 2,840,424 | 6/1958 | Broderick | 248/237 |
| 3,164,353 | 1/1965 | Rene | 248/238 |
| 3,333,802 | 8/1967 | Goodman | 248/237 |
| 3,456,757 | 7/1969 | Sain | 182/111 |
| 3,866,715 | 2/1975 | Foulk | 248/237 |
| 3,970,274 | 7/1976 | Resk | 248/185 |
| 4,078,633 | 3/1978 | Fahy | 182/45 |

FOREIGN PATENT DOCUMENTS

| | | | |
|---|---|---|---|
| 1238167 | 4/1967 | Fed. Rep. of Germany | 182/111 |
| 605775 | 6/1960 | Italy | 182/111 |
| 101307 | 9/1923 | Switzerland | 182/108 |
| 144042 | 6/1920 | United Kingdom | 182/111 |
| 545979 | 6/1942 | United Kingdom | 248/185 |
| 1110879 | 4/1968 | United Kingdom | 182/111 |
| 2142076 | 1/1985 | United Kingdom | 182/111 |

*Primary Examiner*—J. Franklin Foss
*Assistant Examiner*—Robert A. Olson
*Attorney, Agent, or Firm*—John J. Simkanich

[57] ABSTRACT

A bracket forms the base for a scaffolding post and includes a rectangular receiving box with an open top face for receiving and holding a vertically extending scaffolding post. The receiving box pivots about a horizontal axis established by a pin held in a base member of the bracket. This base member includes a flat nailing plate which can be used to secure the bracket to a pitched roof. The pin allows a free pivoting of the receiving box with respect to the angle of the pitched roof to which the nailing plate is attached.

4 Claims, 2 Drawing Sheets

ADJUSTABLE BASE BRACKET FOR PITCHED ROOF SCAFFOLDING POST

BACKGROUND OF THE INVENTION

This invention relates to brackets and specifically relates to brackets used for scaffolding on pitched roofs and shingling brackets and the like.

Various types of adjustable platforms for use on pitched roofs and various types of adjustable brackets for scaffolding have been in use for some time. These devices, however, were not designed to easily accept a vertically extending scaffold post for ease of assembly without nailing, bolting or otherwise attaching this vertically extending post fixedly to the bracket.

By way of example, Nelson, U.S. Pat. No. 2,469,981, shows a pivotal bracket. This device provides a pivot member between two structures to which it is attached. The Nelson device relies on screws and bolts for assembly.

Bauer, U.S. Pat. No. 1,226,169, shows a roof jack having a base member (bar "A") and a support bar ("E") pivoted therefrom and attached thereto by a bolt ("F"). This Bauer roof jack is used as a foot platform on pitched roofs.

Another adjustable foot rest bracket for pitched roofs is shown by Broderick U.S. Pat. No. 2,840,424. The Broderick device includes a flat nailing plate from which a pair of small support tangs 15 extend. A pivot pin 16 is mounted between these tangs 15 and a plank strap 17 being U-shaped and carrying its own tang is pinned to this pin 16. A triangularly shaped plate 20 is attached to the plank strap. This plate 20 operates with a slotted plate 11 attached to the nailing plate and is needed to establish a position for the plank strap 17.

Rene, U.S. Pat. No. 3,164,353, shows a variable pitch roof bracket having members pined together. This device provides an attachment member for horizontal planking as did Broderick.

Foulk, U.S. Pat. No. 3,866,715, shows a pivoted bar and lever structure for providing a horizontal work surface, being a work table for pitched roofs.

Wertz, U.S. Pat. No. 1,452,717, and Kestner, U.S. Pat. No. 1,457,066, both show scaffold jacks including bars or posts pinned together in the classical manner of scaffolding construction.

Fahy, U.S. Pat. No. 4,078,633, shows modular staging platform jacks. Fahy's design purpose was ease of assembly and disassembly for his scaffolding. The Fahy scaffold posts rest on horizontally positioned shoes 24 on the ground. Fahy relies on standard pinned members for his roof mounts.

The present invention provides an improvement and departure from this prior art. It provides a bracket which is intended to be mountable to a pitched roof for supporting the vertical support posts for scaffold jacks. A vertically extending post is held securely and the structure is easily assembled and disassembled.

SUMMARY OF THE INVENTION

An object of the present invention is to provide a bracket for securing a vertical scaffold post to a pitched roof.

A second object of the present invention is to provide such a bracket with a rotational adjustment for various pitch angles of roofing.

A further object of the present invention is to provide such a bracket with a receiving socket or box where the vertical scaffold post is held in position without the use of screws, pins or bolts, thereby facilitating ease of assembly and disassembly.

The objects of the present invention are realized in an adjustable base bracket for pitched roof scaffolds. This bracket has an elongate member base plate of steel with a nailing tongue member extending therefrom.

A pair of juxtaposed walls forms a box support which extends vertically outwardly from base plate. One of these pairs of walls carries a pin which extends between each wall and across the box support. This pin as well as the walls of the box support are made of steel and are of sufficient size and strength to carry the weight of the scaffold.

A receiving box of a shape and size to receive and hold a scaffold post has side walls and a bottom wall made of steel. When the scaffold post is rectangular in shape, this receiving box is rectangular in shape.

A pair of pivot tangs extend downwardly from the bottom of the receiving box. These pivot tangs each have a hole therethrough in alignment with one another. This permits these pivot tangs to be mounted on the pin to allow rotation of the receiving box with respect to the base plate and support box.

DESCRIPTION OF THE DRAWINGS

The features, advantages and operation of the present invention will be understood from a reading of the following detailed description of invention in conjunction with the accompanying drawings in which like numerals refer to like elements and in which.

DETAILED DESCRIPTION OF THE INVENTION

Figure 1:
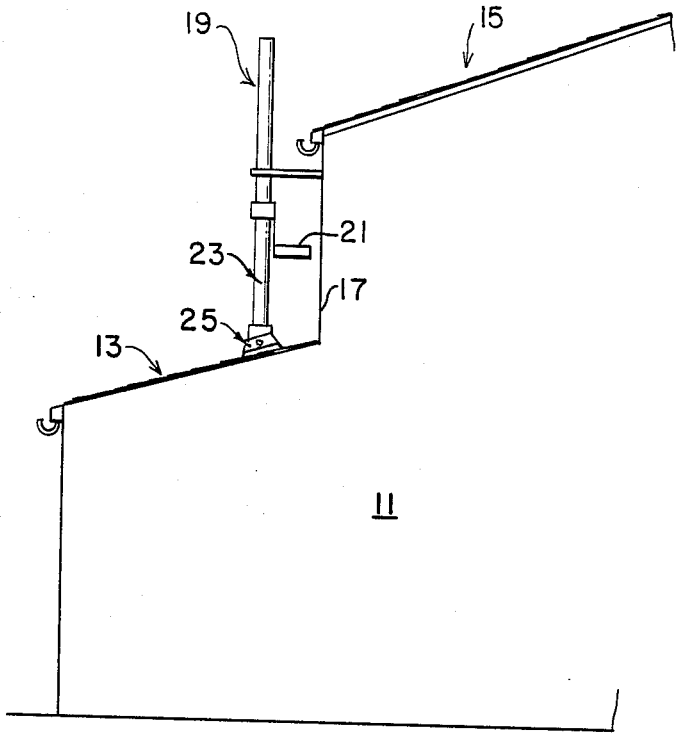
FIG. 1 is a side view of scaffold staging using the base bracket invention.

An adjustable base bracket for scaffold post securements to pitched roofs is provided, FIG. 1. This FIG. 1 shows a building 11 having a lower roof section 13 and an upper roof section 15. Typically, when installing siding on an upper wall 17 of the building 11, scaffolding such as the staging 19 seen in this FIG. 1 is used. This scaffold staging 19 normally includes a platform 21 held in position by one or more vertical posts 23. The scaffold post 23 are held in position on the pitched roof surface 13 by an adjustable base bracket 25.

Figure 2:
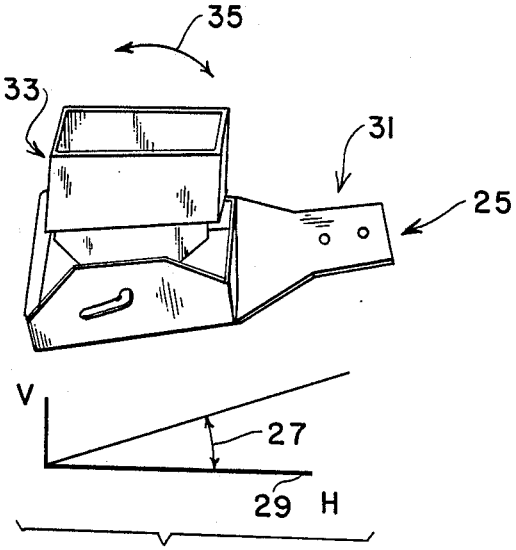
FIG. 2 is a perspective view of the base bracket invention.

This bracket 25 is an assembly of components shown in FIG. 2. The bracket 25, shown in a perspective view, is likewise positioned at an angle 27 from the horizontal 29. The bracket 25 includes a base portion 31 and a post receiving and holding portion 33, which are pinned together so that the post receiving and holding portion 33 can rotate 35 with respect to the base portion 31. The entire bracket structure 25 is made of steel of sufficient strength to provide a safe base for the scaffolded staging 19.

Figure 3:
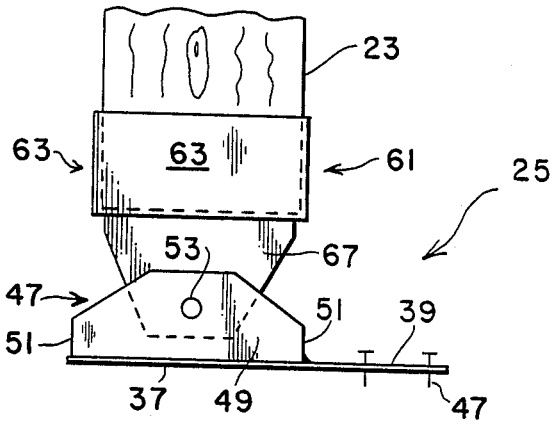
FIG. 3 is a side view of the base bracket invention.
Figure 4:
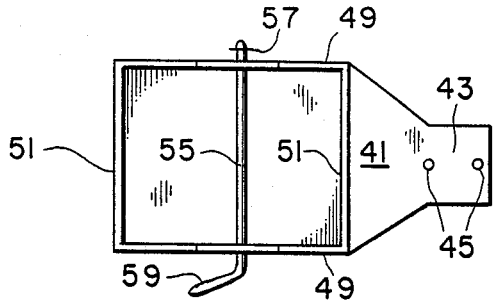
FIG. 4 is a top view of the base plate, support box and pivot pin members.

The base portion 31 of the bracket 25 includes a base plate member 37, FIG. 3. This base plate member has an essentially rectangular configuration, and is square when the scaffold post 23 is square as when a four inch by four inch wooden post is used. The base plate has an extension section which is a flat nailing tang 39. The nailing tang 39 includes a trapezoidal portion 41 and a rectangular tongue extension 43, FIG. 4, carrying a plurality of holes 45 for securing the tongue portion 43 with nails 47, FIG. 3. Typically the base plate 37 and its extension tang 39 are made of ⅛ inch thick steel.

Welded to the base plate portion 37 is a support box 47. This support box 47 has four sides, two of which, being juxtaposed, are trapezoidal shaped 49. The walls of the support box 47 are likewise made of ⅛ inch thick steel and welded together. The trapezoidal shape walls 49 provide a wall height sufficient to allow for the pivoting action of the post receiving and holding portion 33 while cutting down on the weight of the material. The other two walls 51 are about two inches high, while the trapezoidal walls 49 are about four inches high.

Each of the trapezoidal shape walls 49 has a hole 53 centered at the mid point of the wall for receiving a pin 55. These holes 53 are in alignment so that the pin 55 can form a horizontally extending pivot axes. The pivot pin 55 has a keeping washer 57 received in an angular slot on one end thereof, and a bent handle portion 59 at the other end. This pivot pin 55 is made of steel and can be about one inch in diameter.

A receiving box 61 has solid side and a solid bottom wall with an open top portion. This receiving box, FIG. 3, is square shaped when the scaffold post 23, which it holds is square. The receiving box 61 has sides 63 approximately four inches high and four inches long when the scaffold post 23 if a four by four post. This receiving box 61 is constructed of steel and in this instance, the four walls are welded together. A bottom 65 is welded to the side walls. The bottom 65, as well as each of the four side walls 63 are of ⅛ inch carbon steel.

Figure 5:
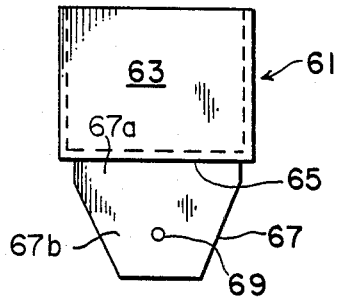
FIG. 5 is a side view of the receiving box and pivot tang members.
Figure 6:
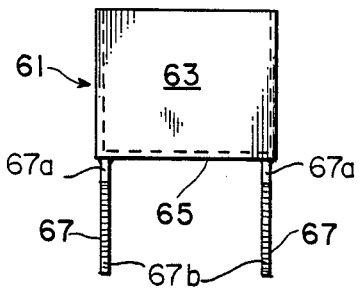
FIG. 6 is an end view of the structure of FIG. 5 as seen from 90 degrees of rotation.
Figure 7:
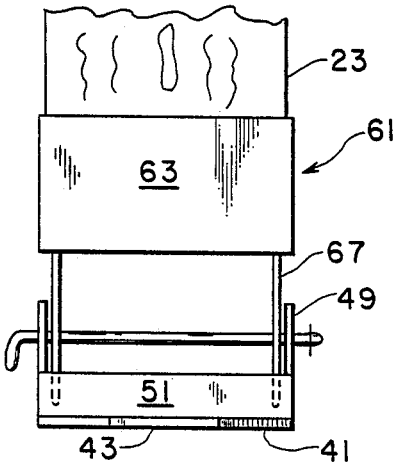
FIG. 7 is an end view of the assembled base bracket of FIG. 3 as seen from 90 degrees of rotation.

A pair of pivot tangs 67, FIGS. 5 and 6, extend downwardly from the bottom 65 of the receiving box 61 and are parallel to one another. These pivot tangs 67 each have a rectangular portion **67*a* which extends downwardly about one inch from the bottom 65 of the receiving box 61 and a trapezoidal portion 67*b* which extends downwardly another approximately four inches. This trapezoidal shape portion 67*b* is so shaped to allow a rotation of the pivot tangs 67 on the pin 59 mounted within the support box 47 created by the wall 51 and 49. Each pivot tang 67 carries a pivot hole 69. These holes 69 are in alignment with one another in order to provide a double legged pivot structure for the receiving box 61. Each of the pivot holes 69 is approximately one inch in diameter. The pivot tangs 67 are welded to the outside face of the bottom 65 adjacent to the location of the side walls 63 of the receiving box 61. As previously suggested, these pivot tangs 67 extend in parallel and are positioned to be slightly inboard of the trapezoidal walls 49 of the support box 47, FIG. 7. The position of the pivot holes 69 and the holes 63 is such that there is a clearance of approximately one inch between the bottom of the trapezoidal portion 67*b* of the pivot tangs 67 and the base plate 37. This allows for a free pivoting of about thirty degrees in either direction from the vertical. Once the receiving box has pivoted this amount, the corner of the trapezoidal portion 67*b* of the pivot tangs 67 strikes the base plate 37** and stops further pivoting.

The present invention provides the advantage of freely pivoting a support box 61 for holding a scaffold post 23 in any position within an arc of about thirty degrees from vertical, for a total pivot arc of sixty degrees. No detents or other stops are employed, except the size and shape of the pivot tangs 67 which limit the degree of rotation from vertical. It is not necessary to employ such detents or stops as the scaffold post 23 is normally held in a fixed position by the staging support bars otherwise incorporated.

The invention is rugged, easily assembled and disassembled, and easily adjusted to any of the majority of pitched roofs.

It is intended that the above description be read as illustrative of the invention. As features may be added to the invention and variations may be made on the structure described, such as the inclusion of positive detents and stops, a change in the shape and size of the receiving box 61, a change in the shape and size of the support box 47 and a change in the shape and size of the base plate 37 as well as the nailing tang 39 or the pivot tangs 67 positioned on the pin 55 outboard of the trapezoidal support walls 49, and still be within the intent and scope of the present invention, it is therefore to be considered that these changes as well as many others are contemplated by the present invention as being within its scope and intent. The invention is not to be limited by the above description.

What is claimed is:

1. An adjustable base bracket for pitched roof scaffolding, comprising:

a base plate member having a floor plate, a single nailing plate extending from the edge of said floor plate, two juxtaposed journal support walls extending upwardly from opposite sides of said floor plate and at least one structural reinforcement wall connecting two juxtaposed journal support walls;

a pair of juxtaposed journal-type openings, one in each of said two journal support walls and extending therethrough;

a pivot shaft extending between said two juxtaposed journal support walls and operative within said journal-type openings;

a receiving member for receiving a scaffold post, said receiving member having a side wall enclosure and a bottom;

a pair of juxtaposed pivot plates extending downwardly from said receiving member bottom, said pivot plates being mounted on said pivot shaft to rotate on said pivot shaft along a vertical plane;

wherein said journal support walls each have a rectangular portion connected to said floor plate and a trapezoidal-like portion above said rectangular portion, said trapezoidal-like portion carrying said journal-type openings within which said pivot shaft operates;

wherein said juxtaposed pivot plates each contain a journal-type opening through which said pivot shaft operates;

wherein said pivot plates have their outer corners truncated into a trapezoidal-like shape and wherein this shape cooperates with the position of said journal-type openings through these pivot plates and said position of said journal-type openings in said journal support walls to allow about sixty degrees of rotation this being about thirty degrees from horizontal in each direction before rotation is stopped by operation of said pivot plates abutting said base plate member.

2. The bracket of claim 1 wherein said receiving member is rectangular and wherein said floor plate is rectangular.

3. The bracket of claim 1 wherein said pivot plates are positioned inwardly from the edges of said rectangular receiving member bottom.

4. The bracket of claim 3 wherein said rectangular receiving member is square and wherein said floor plate is also square shaped.

* * * * *